United States Patent [19]

Ricci

[11] Patent Number: 4,493,238

[45] Date of Patent: Jan. 15, 1985

[54] VIOLIN BOW WITH ADJUSTABLE WEIGHT

[76] Inventor: Ruggiero Ricci, 2930 E. Delhi Rd., Ann Arbor, Mich. 48103

[21] Appl. No.: 458,236

[22] Filed: Jan. 17, 1983

[51] Int. Cl.[3] ..... G10D 3/16

[52] U.S. Cl. ..... 84/282; 84/453

[58] Field of Search ..... 84/282, 422 S, 453

[56] References Cited

U.S. PATENT DOCUMENTS

| | | | |
|---|---|---|---|
| 1,151,413 | 8/1915 | Steckenreiter | 84/282 |
| 3,422,719 | 1/1969 | Payson | 84/422 S |
| 3,545,330 | 12/1970 | Nosco | 84/282 |
| 3,998,123 | 12/1976 | Hinger | 84/422 S |

FOREIGN PATENT DOCUMENTS

| | | | |
|---|---|---|---|
| 163826 | 9/1905 | Fed. Rep. of Germany | 84/282 |
| 109744 | 2/1944 | Sweden | 84/282 |

*Primary Examiner*—Lawrence R. Franklin

*Attorney, Agent, or Firm*—Stephenson and Boller

[57] ABSTRACT

The combination of a violin bow and a weight mounted on the rod section of the bow so that both the magnitude of the weight and the position of the weight relative to the tip of the bow are adjustable. This structure enables tuning of the bow with respect to its bounce characteristics so that the bow will bounce on the violin strings with a speed and force considered desirable by the artist handling the bow.

6 Claims, 3 Drawing Figures

VIOLIN BOW WITH ADJUSTABLE WEIGHT

BACKGROUND OF THE INVENTION

This invention relates generally to violin bows and more particularly to a violin bow which has a weight attachment that is adjustable to control the bounce characteristics of the bow on the violin strings.

In the performance of some musical scores, it is necessary to bounce the violin bow on the violin strings. Different bows have different bounce characteristics. In other words, some bows bounce further and some bows bounce faster than others. In any event, heretofore, the artist has had to accept the inherent bounce characteristics of his violin bow and adapted his musical performance accordingly. Prior art bows do not include any means for adjusting or controlling the bounce characteristics of a bow. The principal object of this invention, therefore, is to remedy this prior art deficiency and enable artists to adjust the bounce characteristics of their violin bows to suit their own artistic needs and desires.

SUMMARY OF THE INVENTION

The standard violin bow has an elongated rod section having a frog at the end gripped by the artist and a tip at the opposite end. Hair is mounted on and extends between the frog and the tip, the frog being adjusted to induce the desired amount of tension in the hair. The hair engages the strings of the violin during use, at times continuously, and at times intermittently, depending upon the musical score that is being performed.

A body member of predetermined weight is snapped onto the rod section at a position closer to the tip than to the frog and frictionally engages the rod section so as to be retained in an adjusted position lengthwise of the rod section. The body member carries removable weights to enable adjustment of the total weight of the attachment on the bow. In use, the position of the body member and the total weight of the body member are adjusted to control the bounce characteristics of the bow and thus enable the artist to "tune" his bow with respect to its bounce capabilities. The result is an enhancement of the artist's capability in performing musical scores that require intermittent engagement of the bow hair with the violin strings.

Further objects, features, and advantages of this invention will become apparent from a consideration of the following description and the appended claims when taken in connection with the accompanying drawing in which:

Figure 1:
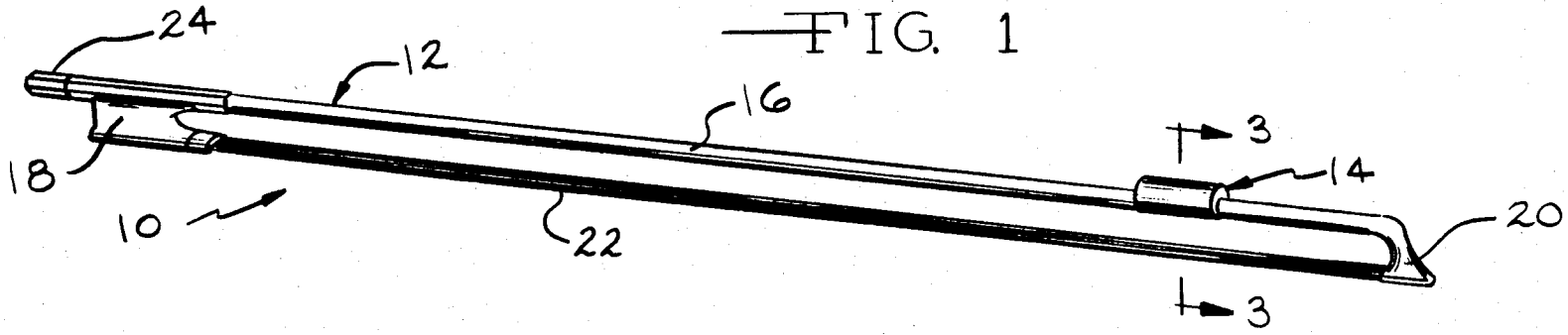
FIG. 1 is a perspective view of the violin bow with adjustable weight of this invention.

With reference to the drawing, the bow and adjustable weight assembly of this invention, indicated generally at 10, is illustrated in FIG. 1 as consisting of a conventional violin bow 12 on which a weight unit 14 is adjustably mounted. The bow 12 includes an elongated rod section 16 having a frog 18 at the end thereof which is manually grasped by the artist, and a tip 20 at the opposite end. Hair 22 is mounted on and extends between the tip 20 and the frog 18. A conventional thumb screw 24 is operable to move the frog 18 toward and away from the tip 20 to produce a desired tension in the hair 22.

Figure 3:
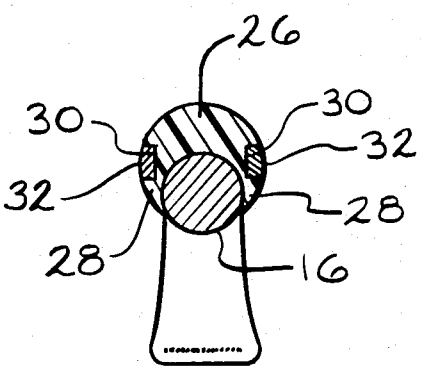
FIG. 3 is an enlarged sectional view of the bow with weight thereon of this invention as seen from substantially the line 3—3 in FIG. 1.

The weight unit 14 consists of a body 26, illustrated as being formed of plastic, but which can be formed of any suitable material of adequate density to constitute a significant weight. As shown in FIG. 3, the body 26 is of generally inverted U-shape so that it has depending leg sections 28 which extend toward each other. In mounting the weight unit 14 on the bow 12, the body 26 is telescoped onto the rod section 16 as shown in FIG. 3 so that the legs 28 frictionally grip diametrically opposite sides of the rod section 16 with sufficient frictional force to insure that the body 26 will remain in an adjusted position lengthwise of the rod section 16. The frictional gripping force of the body 26 on the rod section 16 is insufficient, however, to preclude manual shifting of the body 26 in a direction lengthwise of the rod section 16 toward or away from the tip 20 to a desired adjusted position.

Figure 2:
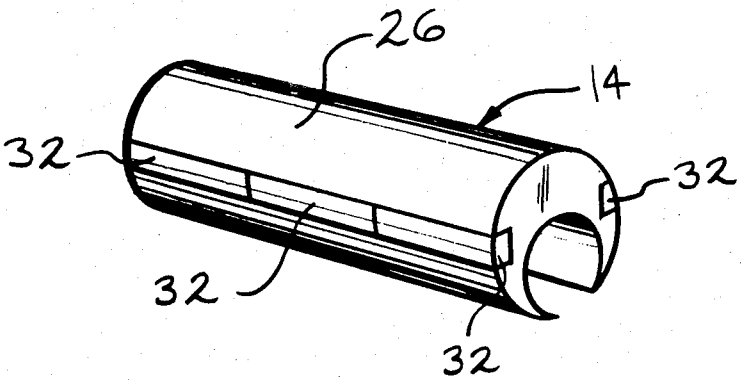
FIG. 2 is a perspective view of the weight unit that is mounted on the violin bow.

As shown in FIGS. 2 and 3, the legs 28 of the body 26 are provided with lengthwise slots 30 in which a plurality of small weight members 32 are frictionally retained. The number of weight units 32 mounted on the body 26 can thus be adjusted to in turn adjust the total weight of the unit 14.

In the use of the bow and weight assembly 10, the number of weight members 32 is adjusted and the position of the unit 14 lengthwise of the rod section 16 is adjusted to obtain the desired bounce characteristics in the bow 12. By this is meant, the speed of rebound of the bow 12 from the violin strings and the magnitude of the rebound can be adjusted by moving the unit 14 and adjusting the number of weight members 32 to tune the assembly 10 to achieve the bounce characteristics desired by the artist. It is expected that the unit 14 will always be closer to the tip 20 than to the frog 18.

What is claimed is:

1. In combination with a bow for string type musical instruments wherein said bow includes an elongated rod section having a frog at one end and a tip at the opposite end, and hair mounted on and extending between said frog and said tip, said hair being engageable with the strings of a musical instrument during use, means for controlling the bounce characteristics of said bow on said strings comprising weight means adjustably mounted on said rod section intermediate said ends thereof for movement lengthwise of said rod section between a plurality of positions thereon.

2. The structure according to claim 1 wherein said weight means comprises a body member frictionally mounted on said rod section.

3. The structure according to claim 2 wherein said body member is mounted on said rod section at a position closer to said tip than to said frog.

4. The structure according to claim 2 wherein said body member is slidably mounted on said rod section for movement lengthwise thereof.

5. The structure according to claim 2 wherein said body member is shaped to telescope over said rod section, said body member having depending legs frictionally engaged with diametrically opposite sides of said rod section.

6. The structure according to claim 2 further including a plurality of weight members removably mounted on said body to enable adjustment of the weight means to thereby enable tuning of said bow to obtain the desired bounce characteristics of the bow.

* * * * *